United States Patent [19]

Jones, Jr. et al.

[11] 3,950,623

[45] Apr. 13, 1976

[54] AUTOMATION SWITCHING APPARATUS

[75] Inventors: Clarence O. Jones, Jr., Eggertsville; William F. Abraham, Lancaster, both of N.Y.

[73] Assignee: Niagara Machine & Tool Works, Buffalo, N.Y.

[22] Filed: Oct. 10, 1974

[21] Appl. No.: 513,598

[52] U.S. Cl. ..... 200/31 R; 200/25; 200/153 R

[51] Int. Cl.[2] ..... H01H 19/62; H01H 3/16

[58] Field of Search ..... 200/23, 25, 28, 30 R, 30 A, 200/31 R, 31 A, 38 R, 38 B, 38 BA, 38 C, 38 CA, 153 T, 153 R, 153 N

[56] References Cited

UNITED STATES PATENTS

| | | | |
|---|---|---|---|
| 2,844,670 | 7/1958 | Witte | 200/38 CA UX |
| 2,903,528 | 9/1959 | Kuhn | 200/30 R X |
| 3,483,344 | 12/1969 | Hermle et al. | 200/38 BA X |
| 3,510,610 | 5/1970 | Jones, Jr. et al. | 200/25 |
| 3,612,800 | 10/1971 | Slopa | 200/153 T |
| 3,852,542 | 12/1974 | Rogers et al. | 200/31 R |

*Primary Examiner*—James R. Scott
*Attorney, Agent, or Firm*—Christel & Bean

[57] ABSTRACT

Apparatus for performing a plurality of switching operations in response to input rotary motion. An input shaft rotatably positioned in a housing has a plurality of cams axially positioned therealong, and a corresponding plurality of cam-operated electrical switches are positioned along the shaft, each switch being fixed to a corresponding carrier element movably connected to the housing. A motion transmitting means in the form of a shaft having a worm fixed thereon operatively engages a carrier element, in particular a series of teeth on the element, for moving the element to move the switch carried thereby in a manner adjusting the rotational orientation of the switch relative to the corresponding cam. An identical arrangement can be provided for each switch to allow independent adjustment, or the switch carriers can be connected together for simultaneous adjustment.

15 Claims, 5 Drawing Figures

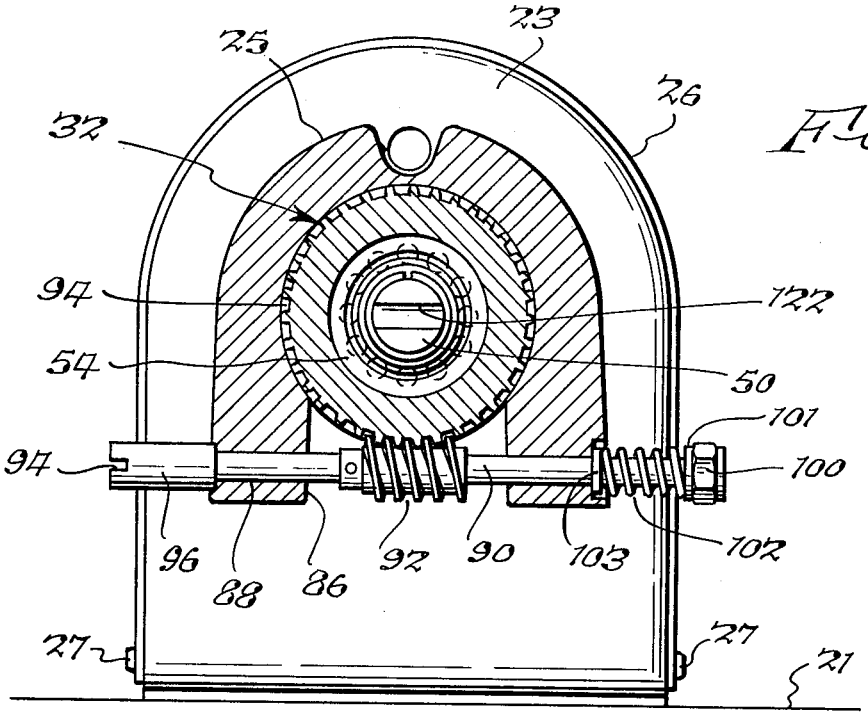
Fig. 3.
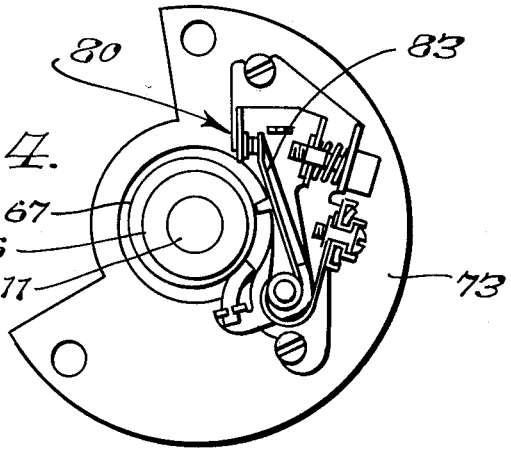
Fig. 4.
Fig. 5.
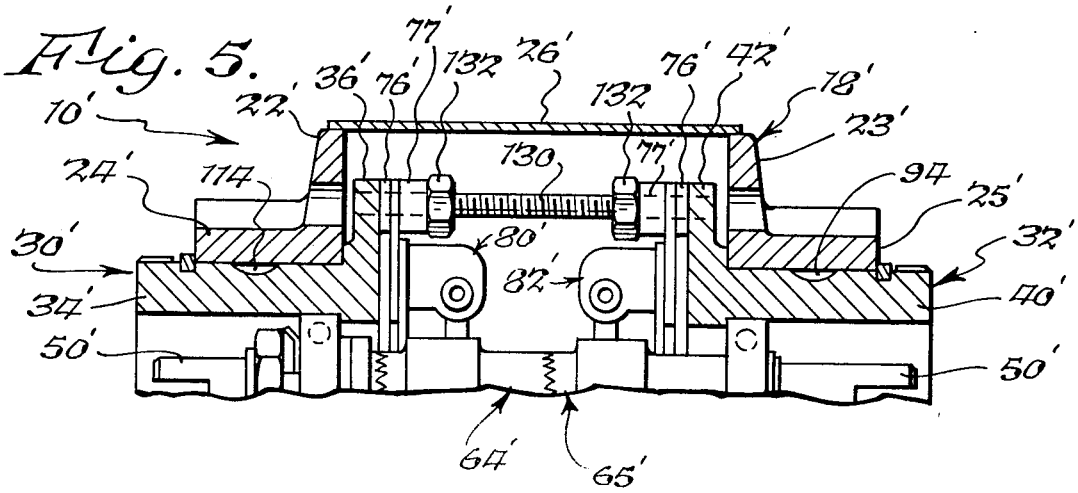

AUTOMATION SWITCHING APPARATUS

BACKGROUND OF THE INVENTION

This invention relates to switching apparatus, and more particularly to apparatus for performing a plurality of switching operations in response to input rotary motion.

One area of use of the apparatus of the present invention is in the machine control art wherein the input rotary motion may be derived from the machine drive shaft and the switching operations thus performed, in conjunction with electrical circuits, control the operation of auxiliary apparatus associated with the machine in timed relationship with the machine operating cycle. A particular example of such a machine is a power press having auxiliary or automation apparatus such as roll feed equipment, air blow off equipment, and die moving devices. By way of illustration the present invention will be described with particular reference to such machines and auxiliary apparatus, although the principles of the invention may be variously applied.

Such auxiliary apparatus often requires a very precise adjustment, for example with 1° of shaft rotation for some types of equipment, and therefore there is a need to provide rotary switching apparatus capable of this degree of adjustment. Furthermore, the switching apparatus should maintain the adjustment even though subjected to vibration and similar influences when mounted on or adjacent a machine. In addition, it would be highly desirable to provide switching apparatus which can be adjusted while the associated machine and auxiliary apparatus are in operation.

SUMMARY OF THE INVENTION

The present invention provides machine-driven switching apparatus for controlling the operation of auxiliary or automation apparatus associated with the machine. The apparatus includes a plurality of switches operated periodically in response to shaft rotation, and the orientation of the switches relative to the shaft is adjustable by means providing a very precise degress of adjustment. A corresponding plurality of adjustment means can be provided to allow independent adjustment of the switches, or the switches can be connected together and simultaneously adjusted by a single adjustment means. The apparatus further includes a vibration damping means operatively associated with the adjustment means for positively maintaining the setting or adjustment.

While several specific embodiments of the principles of the present invention are illustrated in the accompanying drawing and described in detail in the following specification, it is to be understood that such embodiments are by way of example only and that various mechanical modifications may be made without departing from the spirit of the invention, the scope of which is limited only as defined in the appended claims.

BRIEF DESCRIPTION OF THE DRAWINGS

FIG. 3 is a cross-sectional view taken about on line 3—3 of FIG. 2;

FIG. 4 is a side elevational view of a switch incorporated in the apparatus of FIGS. 1—3; and FIG. 5 is a fragmentary longitudinal sectional view of another embodiment of the switching apparatus of the present invention.

DETAILED DESCRIPTION OF THE ILLUSTRATED EMBODIMENT

Figure 1:
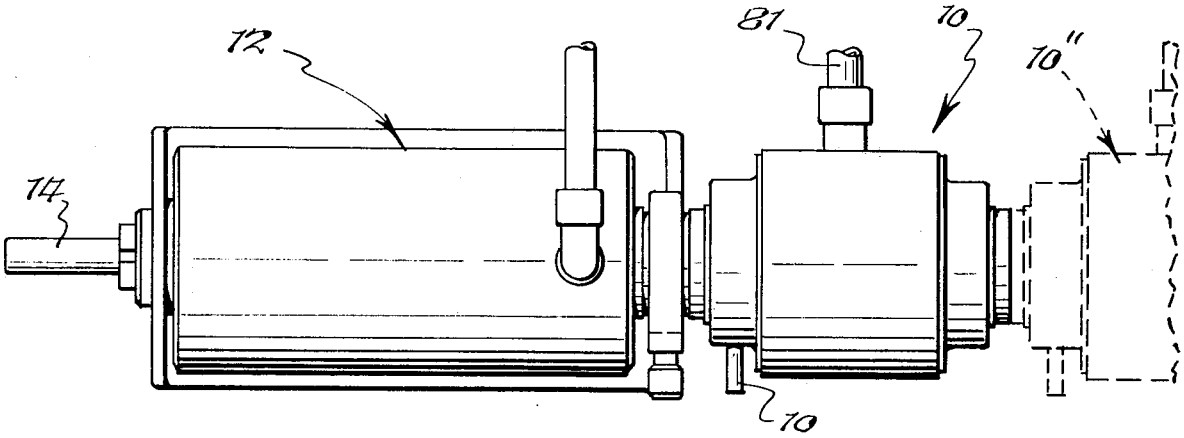
FIG. 1 is a plan view of the switching apparatus of the present invention and showing one arrangement for operating the same.

Like characters of reference denote like parts throughout the several figures of the drawings and, referring to FIG. 1, the switching apparatus of this invention is generally designated 10 and preferably can be driven by a rotary switch generally designated 12 similar to the switching apparatus disclosed in U.S. Pat. No. 3,510,610 issued May 5, 1970 and assigned to the assignee of the present invention, the disclosure of which is hereby incorporated by reference. Switch 12 may be mounted at a convenient location on a machine to be controlled such as a power press and has an input shaft 14 coupled through suitable means to the machine drive shaft. Switch 10 of the present invention also may be mounted at a convenient location on or adjacent the machine, and the other end of shaft 14 is coupled by suitable means to the input shaft of switch 10 of the present invention in a manner which presently will be described. A number of switches can be mechanically coupled in a series if desired, and by way of example FIG. 1 indicates the manner in which another switch 10'' would be connected to switch 10 in such an arrangement.

Figure 2:
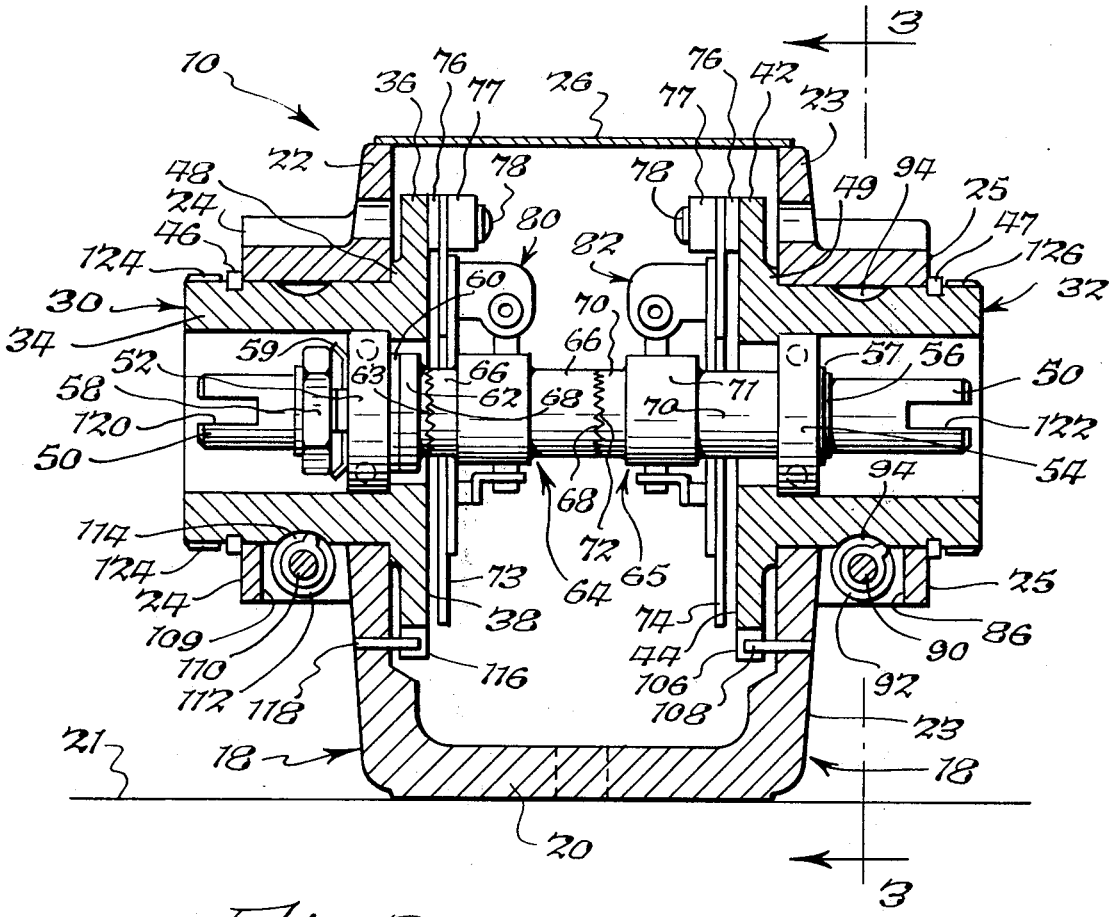
FIG. 2 is a longitudinal sectional view of the switching apparatus of the present invention.

As shown in FIG. 2 the switching apparatus 10 of the present invention comprises a housing 18 having a base or bottom portion 20 which can reset on or be mounted to a supporting surface 21 such as a surface of a machine when switch 10 is installed for use. Housing 18 also has spaced-apart opposite sidewall portions 22 and 23 which are formed to include generally cylindrical extensions or hub-like portions 24 and 25, respectively, the extensions 24, 25 being located relative to each other such that the central, longitudal openings or passages thereof are in axial registry or alignment with each other. The portion of housing 18 including base 10, sidewalls 22, 23 and hubs 24, 25 preferably is cast or otherwise formed to be of integral construction. Housing 18 is completed by a relatively thin-wall cover portion 26 which fits around and over the peripheral edges of the sidewall portions 22, 23 and which is secured by suitable fasteners 27 at opposite ends thereof to corresponding opposite ends of base 20 as shown in FIG. 3.

The switching apparatus of the present invention further comprises a pair of switch carrier elements 30 and 32 rotatably received in housing 18, being received in corresponding hub portions 24 and 25, respectively. In particular, each switch carrier, for example carrier 30, has a sleeve-like, cylindrical body portion 34 having an outer diameter of a size such that it fits snugly but rotatably within the opening defined by hub 24. Body portion 34 has an axial length such that is extends outwardly beyond the end face of hub 24 and extends slightly inwardly of housing sidewall 22 where it meets an annular or ring-shaped body portion 36 thereof. The annular body portion 36 is spaced a relatively small distance axially inwardly of sidewall portion 22 and has an inner surface 38 disposed in a plane generally parallel of the plane of wall portion 22. Switch carrier 32 is identical to carrier 30 and includes a cylindrical body portion 40 and an annular or ring-shaped body portion 42 having an inner surface 44. Inward axial movement of switch carriers 30 and 32 is prevented by snap rings 46 and 47 seated in annular grooves provided in carriers 30 and 32, respectively, which rings 46 and 47 abut against corresponding axial end faces of hub portions 24 and 25, respectively. Outward axial movement of switch carriers 30 and 32 is prevented by annular shoulders 48 and 49, respectively, formed on the carriers at the juncture between the cylindrical and annular body portions thereof.

The switching apparatus of the present invention further comprises an input shaft 50 which is rotatable within housing 18, being rotatably supported therein by means of bearing 52 within carrier 30 and bearing 54 within carrier 32. Bearings 52, 54 abut against annular shoulders in carriers 30 and 32, respectively, defined by the two different inner diameter portions in each carrier so as to prevent axial inward movement of bearings 52, 54. Bearing 54 is fixed axially relative to shaft 50 against axial outward movement by means of a snap ring 56 fitted in an annular groove provided in shaft 50 and a washer 57 placed on shaft 50 between snap ring 56 and bearing 54. Adjacent the left hand end of shaft 50 as viewed in FIG. 2, a lock nut 58 is threaded to shaft 50 and when so secured urges a lock washer 59 against bearing 52. A spacer ring 60 is positioned on shaft 50 in axial abutment with the other opposite face of bearing 52, and a driver element 62 provided with teeth 63 is fixed on shaft 50 against spacer ring 60, the latter being included for tolerance.

Positioned axially along shaft 50 are a pair of motion transmitting elements in the form of cams 64 and 65. In preferred form each cam, for example cam 64, includes a cylindrical body portion 66 and a lobe portion 67. In addition, cam 64 is provided with teeth 68 circumferentially around each axial end thereof, and the teeth on the left-hand end of cam 64 as viewed in FIG. 2 engage teeth 63 of driver element 62. Similarly, cam 65 includes a cylindrical body portion 70, a lobe portion 71, and has teeth 72 circumferentially around the left-hand axial end as viewed in FIG. 2. Teeth 72 of cam 65 engage teeth 68 on the right-hand end of cam 64 as viewed in FIG. 2, and the smooth axial end face at the opposite end of cam 65 abuts bearing 54. Upon engagement between the teeth of cams 64, 65 and the teeth of cam 64 and driver 62, the relative rotational orientation of cams 64, 65 on shaft 50 is fixed. The relative rotational orientation of cams 64 and 65, in turn, may be adjusted upon disengagement between the teeth of cams 64, 65 in a manner which will be described presently.

A corresponding pair of plates 73, 74 are connected to the switch carriers 30 and 32, respectively, in spaced relation thereto, and each plate is substantially disc-shaped having a central opening sufficient to allow passage of shaft 50 and cams 64, 65 therethrough, each plate being positioned in proximity to one of the cams. Plate 73 is mounted in spaced relation to carrier 30 by means of an assembly including a bushing 76 having an annular body portion which fits between carrier 30 and the adjacent face of plate 73 and a smaller diameter portion extending through an opening in plate 73, a spacer 77 or bushing which fits on bushing 76 and against the opposite face of plate 73, and a screw 78 which fits through the assembly and threads into carrier 30. Bushing 76 and spacer 77 are of electrically insulating material whereby plate 73 is electrically insulated from carrier 30. In a similar manner, plate 74 is mounted in spaced relation to carrier 32 by an identical arrangement of bushing 76, spacer 77 and screw 78 so that plate 74 is electrically insulated from carrier 32.

The switching apparatus of the present invention further comprises a pair of electrical switches 80 and 82 attached to plates 73 and 74, respectively. Each switch has a movable arm, for example arm 83 of switch 80 shown in FIG. 4 which is periodically moved by a corresponding cam to open and close the switch. Each switch is electrically connected in an external control circuit of the auxiliary equipment in a manner readily understood by those skilled in the art, and the wires for making such connections leave switching apparatus 10 through conduit 81 shown in FIG. 1. The construction and operation of switches 80 and 82 is similar to the switches shown and described in U.S. Pat. No. 3,510,610 mentioned above so that a detailed description of the switches is believed to be unnecessary. Briefly, and referring to FIG. 4, switch 80 includes a base rigidly attached to plate 73 and switch arm 83, which has an electrical contact adjacent one end and a cam follower portion adjacent the mid-portion thereof, is pivotally connected adjacent the other end to the base. Another electrical contact is fixed to the base, and the two contacts are spring biased to a normally closed position. Switch 80, like the switches disclosed in the aforementioned patent, has means for adjusting the rest position of the cam follower of switch 80 relative to the axis of shaft 50 and thus relative to the axis of the corresponding cam to adjust the dwell angle. Switch 82 is identical to switch 80.

The switching apparatus of the present invention further comprises motion transmitting means operatively engaging the carrier elements for moving the elements to move the switches about shaft 50 in a manner adjusting the rotational orientation of the switches relative to the cams on the shaft. In particular, there is provided means for rotating carriers 30 and 32 to which the switches 80 and 82, respectively, are connected about shaft 50 and thus relative to cams 64 and 65. As shown in FIG. 3, hub portion 25 of sidewall 23 is provided with a recess or open region 86 and with aligned bores 88, 89 communicating with region 86 for receiving a shaft 90. A worm 92 is fixed to shaft 90 adjacent the mid portion thereof and is located in region 86. A portion of the circumference of carrier 32 extends into region 86, and worm 92 engages teeth 94 provided circumferentially around the outer surface of body portion 40 of carrier 32. Teeth 94 are in a path concentric with input shaft 50. Shaft 90 has a slightly larger diameter end portion 96 provided with a notch 97 to receive a screwdriver or similar instrument, for example, for applying input rotary motion to shaft 90 for rotating worm 92 to rotate carrier 32. The annular shoulder defined at the juncture of portion 96 and the main body of shaft 90 abuts the surface of hub portion 25 and fixes shaft 90 against axial movement to the right as viewed in FIG. 3.

The opposite end of shaft 90 is provided with means for damping vibration and locking worm 92 to teeth 94. In particular, there is provided an assembly including a nut 100 threaded onto the outer end of shaft 90, a washer 101 adjacent nut 100, a coil spring 102 fitted on shaft 90 and having one end abutting washer 101, and a washer 103 urged by the other end of spring 102 against a recessed surface of hub portion 25. Due to the ratio of teeth on carrier 32 to threads on worm 92, worm 92 tends to lock against carrier 32, but the foregoing arrangement insures a positive lock by damping vibrations to which the switching apparatus may be exposed when mounted on or adjacent machinery. There is also provided means for limiting the amount of rotation of carrier 32 in one direction in the form of a tooth or detent 106, shown in FIG. 2, provided on the periphery of the carrier body portion 42 and a stop member such as a roll pin 108 fixed in housing 18, in particular in wall portion 23, for engaging detent 106 at the desired stop position. In the present illustration, the arrangement of pin 108 for engaging detent 106 limits rotation of carrier 32 to rotation of 360° in either direction. This prevents the wires connected to switch 82 on carrier 32 from being excessively wound or entangled or otherwise damaged by continued rotation of carrier 32 in one direction.

An identical arrangement is provided for rotating carrier 30 in the housing hub portion 24. Thus, hub portion 24 has a region 109 like region 86 and a shaft 110 rotatably connected in hub portion 24 carries a worm 112 shown in FIG. 2 which engages threads 114 on carrier 30 for rotating the same. Shaft 110 likewise is provided with a notch in the outer end face to receive a screwdriver or similar instrument for rotating shaft 110 and worm 112 to rotate carrier 30. Shaft 110 further is provided with an assembly (not shown) identical to the combination of nut, washes and coil spring shown in FIG. 3 for damping vibration and insuring a positive lock between worm 112 and carrier 30. Likewise there is provided means for limiting the amount of rotational movement of carrier 30 in one direction in the form of a detent or tooth 116 provided on carrier 32 and for engaging the roll pin 118 fixed in housing wall 22.

As shown in FIG. 2, input shaft 50 is provided with notches 120 and 122 at opposite ends thereof to facilitate coupling. In particular, in the arrangement illustrated in FIG. 1 the lefthand end of shaft 50 would be coupled directly to the shaft of switch 12 shown in FIG. 1 by a suitable coupling, for example a sliding coupling known in the art as an Oldham coupling which is a flexible type coupling employing a sliding block. If only one switch 10 is installed, the righthand end of shaft 50 is free as shown in FIG. 2. On the other hand, if the arrangement includes another switch 10' similar to switch 10 and in series therewith as indicated in FIG. 1. then to the right-hand end of switch 50 is connected a suitable coupling, for example the previously mentioned Oldham coupling, for driving the shaft of the next switch 10' in the series arrangement. A number of switches 10, 10' etc. can be connected mechanically in series in the foregoing manner.

The switching apparatus 10 of the present invention operates in the following manner. A principal area of use is in controlling machines wherein the input rotary motion is derived from the machine drive shaft and the switching operations thus performed by the apparatus of the present invention, in conjunction with electrical circuits, control the operation of auxiliary apparatus associated with the machine in timed relationship with the machine operating cycle. A particular example of such a machine is a power press having auxiliary or automation apparatus such as roll feed equipment, mechanical hands for manipulating workpieces, air blow off equipment, and die moving devices. The press slide or ram is moved downward to press a workpiece and is returned to a top stop position during a working cycle, and the auxiliary apparatus will perform a particular operation or operations during or after each working cycle. For example, automatic roll lifters of roll feed equipment are operated for each press cycle, mechanical hands are operated at the end of each cycle to remove a finished workpiece and replace it with one to be pressed during the next cycle, and air blow off equipment is operated at the end of each cycle. The switching apparatus 10 of the present invention can control the on-off state of such auxiliary equipment in timed relation to the press working cycle, in which case each switch 80, 82 would be connected in the electrical control circuit of a different piece of such equipment. Alternatively, each switch 80, 82 can be in a circuit associated with a different control mode of the same piece of equipment.

Each rotation of the press drive shaft comprises one working cycle and each rotation of the press drive shaft causes a corresponding rotation of shaft 50 of the switching apparatus. During each rotation of the press drive shaft and thus shaft 50, lobes 67 and 71 of cams 64 and 65, respectively, contact and move the follower portions of the switch arms of switches 80 and 82, respectively, so as to open the switch contacts for a predetermined time and thereafter leave the followers resulting in reclosing of the contacts. The automation equipment control circuit including the contacts of switch 80, in response to the opening thereof, for example, would signal clutching and debraking of the roll feed equipment to advance the roll of sheet metal and would signal braking and declutching to stop the movement of the roll in response to reclosing of the contacts. The contacts of switch 82 could be connected in the electrical control circuit for controlling operation of the roll lifters of the roll feed equipment.

The time at which opening of the switch contacts occurs during each rotation of shaft 50, and hence during each working cycle of the press is set and adjusted by the apparatus of the present invention in the following manner. The rotational orientation of each switch 80, 82 and hence its cam follower is set or adjusted relative to shaft 50 and the corresponding cam lobes 67 and 71 by rotating each worm 112, 94 to rotate the corresponding switch carrier 30, 32. In particular, in order to set or adjust the time at which the contacts of switch 80 are first opened in the working cycle, the person setting up the equipment can use a screwdriver to turn shaft 110 to rotate worm 112 to rotate carrier 30 until the desired setting is obtained as determined by a visual inspection of scale 124 on carrier 30 provided with gradations in degrees which can be read against a fixed point on hub 24. Likewise, to make the same type of setting or adjustment for switch 82, shaft 90 is turned in a similar manner to rotate worm 92 to rotate carrier 32 until the desired setting is obtained as determined by a visual inspection of scale 126 on carrier 32 provided with graduations in degrees which can be read against a fixed point on hub 25. The provision of a worm engaging teeth on a carrier element enables a very precise setting or adjustment to be made, that is with a precision or accuracy of about 1° of shaft rotation. Such precision often is necessary with auxiliary or automation apparatus of the foregoing type. In addition, the tendency of the work to lock aginst the teeth of the corresponding carrier element together with the positive locking provided by the arrangement of coil spring, nut and washers on each shaft, insures that such settings or adjustments, once made, will be maintained even if the switching apparatus 10 is subjected to vibration. The foregoing settings or adjustments will be made when the equipment is set-up or installed and generally will not be changed during operation of the equipment. Should subsequent adjustment be necessary, however, this can be done while apparatus 10 is operating without any need to shut it down.

The time at which reclosing of the switch contacts occurs during each rotation of shaft 50, and hence during each working cycle of the press, is determined by the length of time that the cam lobe engages the follower to hold the contacts open. This time is also known as the dwell angle and may also be adjusted by changing the radial distance between the cam follower in what may be designated a rest position and the axis of the cam. Housing cover 26 is removed and the adjusting screw of the particular switch in question is turned to move the portion of the switch assembly containing the switch arm and cam follower toward or away from shaft 50. This adjustment is made in a manner identical to that described in the aforementioned U.S. Pat. No. 3,510,610. In addition, while the foregoing adjustments or settings are made before the equipment is placed in operation, subsequent adjustments if necessary can be made while switching apparatus 10 is operating without any need to shut it down.

When the switching apparatus is first installed on the machine and auxiliary equipment to be controlled, it may be necessary to adjust the synchronism among the various switches, especially if a number of units of the switching apparatus are connected mechanically in series. This is done by changing the relative rotational orientation of the cams on the shaft in the following manner. The cams 64, 65 are shown in FIG. 2 locked against relative rotation on shaft 50. Nut 58 may be loosened and, together with washer 59, moved a short distance to the left along shaft 50, whereupon the shaft can be moved axially within bearings 52, 54 a short distance to the right as viewed in FIG. 2. This frees cams 64, 65 enabling the adjacent teeth to be disengaged by displacing each of the cams slightly along shaft 50 to permit independent rotation of the cams. When the desired relative orientation is obtained, shaft 50 is moved to the left, thus urging cams 64, 65 together so that the corresponding sets of teeth lock in engagement and so that the teeth of driver 62 lock with the teeth of cam 64. Washer 59 is moved back into position and nut 58 is threaded back on shaft 50 to maintain the fixed axial relationship.

FIG. 5 illustrates another embodiment of the switching apparatus of the present invention, and the components thereof identical to those of the switching apparatus of FIGS. 1–4 are identified by the same reference numeral with a prime designation. In this embodiment, the switch carriers 30′ and 32′ are joined together in a manner providing simultaneous movement of both carriers in response to movement of either carrier. In particular, a bolt 130 is connected at opposite ends to corresponding assemblies of carrier portion 36′ and bushings 76′, 77 and carrier portion 42′ and bushings 77. A pair of nuts 132 threaded on opposite ends of bolt 130 against corresponding bushings 77′ secure bolt 130 in place. Only one assembly including shaft and worm is provided, for example a shaft connected in hub 24′ having a worm engaging threads 114′ on carrier 30′, whereupon turning of the shaft rotates carrier 30′ in the manner as before, and rotation of carrier 30′ rotates carrier 32′ by the same amount through the connection provided by bolt 130. The switching apparatus 10′ of this embodiment is useful in controlling equipment having dual functions wherein it is necessary to have the two switches 80′ and 82′ normally open or normally closed at the same time in the working cycle.

The switching apparatus of the present invention provides control of the operation of auxiliary or automation apparatus associated with a main machine in timed relationship with the machine operating cycle. The provision of motion transmitting means operatively engaging the carrier elements in the form of a worm engaging threads on the carrier enables a very precise adjustment to be made. The means for damping vibration and locking the worm to the threads insures that the settings or adjustments, once made, will be maintained.

We claim:

1. In combination with a machine having auxiliary apparatus and a plurality of electrical circuits for controlling the operation of said apparatus, switching apparatus comprising:

a. a housing;

b. an input shaft rotatably supported in said housing;

c. a plurality of carrier elements movably connected to said housing at spaced locations along said shaft for movement relative to said shaft about the circumference thereof;

d. a plurality of electrical switches fixed to corresponding ones of said carrier elements and connected in said electrical circuits, said switches each including a movable arm;

e. a plurality of cams axially positioned on said shaft in a manner such that upon rotation of said shaft each of said cams will periodically move a corresponding one of said switch arms; and f. motion transmitting means operatively engaging at least one of said carrier elements for moving said element to move the corresponding one of said switches about said input shaft in a manner adjusting the rotational orientation of said switch relative to said cams, said motion transmitting means comprising shaft means threadably engaging said carrier element in a manner such that upon rotation of said shaft means said carrier element is moved about said input shaft.

2. The combination according to claim 1, including motion transmitting means for each of said carrier elements comprising a plurality of shaft means each threadably engaging a corresponding one of said elements whereby said carrier elements are independently adjustable.

3. The combination according to claim 1, including means for coupling the drive shaft of said machine to said input shaft.

4. The combination according to claim 3, wherein said coupling means comprises rotary switching apparatus for controlling the operation of said machine, said rotary switching apparatus having a shaft, one end of which is coupled to the drive shaft of said machine and the other end of which is coupled to said input shaft of said switching apparatus.

5. The combination according to claim 1, including vibration damping means operatively connected to said shaft means for maintaining said shaft means threaded engagement with said carrier element whereby once an adjustment of said carrier element is made the adjustment is maintained until another embodiment is made.

6. The combination according to claim 1, including means on said carrier element for engaging a stationary stop means on said housing for limiting the amount of movement of said carrier element in one direction.

7. The combination according to claim 1, including independent adjustment means on each of said switches for adjusting the rest position of said movable arm relative to the axis of said input shaft.

8. The combination according to claim 1, including locking means on opposite axial ends of each of said cams for engaging corresponding locking means on axially adjacent cams to hold said cams in a fixed relative rotational alignment when urged into end-to-end engagement on said input shaft.

9. In combination with a machine having auxiliary apparatus and a plurality of electrical circuits for controlling the operation of said apparatus, switching apparatus comprising:

a. a housing;
b. an input shaft rotatably supported in said housing;
c. a plurality of carrier elements movably connected to said housing at spaced locations along said shaft for movement relative to said shaft about the circumference thereof;
d. means for rigidly connecting said carrier elements together for simultaneous, non-relative movement about said shaft;
e. a plurality of electrical switches fixed to corresponding ones of said carrier elements and connected in said electrical circuits, said switches each including a movable arm;
f. a plurality of cams axially positioned on said shaft in a manner such that upon rotation of said shaft each of said cams will periodically move a corresponding one of said switch arms; and
g. motion transmitting means operatively engaging one of said carrier elements for converting an input motion applied to said motion transmitting means into simultaneous movement of said carrier elements to move said switches simultaneously about said shaft in a manner simultaneously adjusting the rotational orientation of said switches relative to said cams.

10. In combination with a machine having auxiliary apparatus and a plurality of electrical circuits for controlling the operation of said apparatus, switching apparatus comprising:

a. a housing;
b. an input shaft rotatably supported in said housing;
c. a plurality of carrier elements movably connected to said housing at spaced locations along said shaft for movement relative to said shaft about the circumference thereof;
d. a plurality of electrical switches fixed to corresponding ones of said carrier elements and connected in said electrical circuits, said switches each including a movable arm;
e. a plurality of cams axially positioned on said shaft in a manner such that upon rotation of said shaft each of said cams will periodically move a corresponding one of said switch arms; and
f. motion transmitting means operatively engaging at least one of said carrier elements for moving said element to move the corresponding one of said switches about said input shaft in a manner adjusting the rotational orientation of said switch relative to said cams, said motion transmitting means comprising a shaft rotatably positioned in said housing operatively adjacent a corresponding carrier element and a worm fixed to said shaft, said corresponding carrier element being provided with a series of teeth for engagement with said worm whereby turning of said shaft rotates said worm to move said corresponding carrier element.

11. The combination according to claim 10, wherein each carrier element has a generally cylindrical body portion, said carrier element being rotatably connected to said housing and generally concentric with said input shaft, said teeth being provided circumferentially on said carrier element along a path generally concentric with said input shaft.

12. The combination according to claim 10, including spring means connected to said shaft and abutting said housing for maintaining said worm in positive engagement with said carrier teeth.

13. The combination according to claim 10, including a stop element on said housing for engaging said carrier after a predetermined movement of said carrier for limiting the amount of movement of said carrier in one direction.

14. The combination according to claim 10, including a plurality of shafts rotatably positioned in said housing each being operatively adjacent a corresponding one of said carrier elements and having a worm fixed thereon for engagement with teeth on the corresponding carrier element whereby each carrier element is independently adjustable.

15. The combination according to claim 10, including means connected said carrier elements together whereby turning of said shaft to rotate said worm causes simultaneous movement of said carrier elements.

* * * * *

UNITED STATES PATENT AND TRADEMARK OFFICE

CERTIFICATE OF CORRECTION

PATENT NO. : 3,950,623

DATED : April 13, 1976

INVENTOR(S) : Clarence O. Jones, Jr. et al

It is certified that error appears in the above-identified patent and that said Letters Patent are hereby corrected as shown below:

Claim 2, line 4, --carrier-- should be inserted after "said";

Claim 5, line 3, --in-- should be inserted after "means"; and

Claim 5, line 6, change "embodiment" to --adjustment--.

Signed and Sealed this

Twentieth Day of July 1976

[SEAL]

*Attest:*

RUTH C. MASON
*Attesting Officer*

C. MARSHALL DANN
*Commissioner of Patents and Trademarks*